US006379174B1

(12) United States Patent
Siemon et al.

(10) Patent No.: US 6,379,174 B1
(45) Date of Patent: Apr. 30, 2002

(54) HIGH PERFORMANCE WIRING CONNECTING SYSTEM

(75) Inventors: John A. Siemon, Woodbury; Randy J. Below, Cheshire; Brian Tulley, Naugatuck; Robert C. Carlson, Jr., Torrington; Olindo J. Savi, Berlin, all of CT (US)

(73) Assignee: The Siemon Company, Watertown, CT (US)

( * ) Notice: Subject to any disclaimer, the term of this patent is extended or adjusted under 35 U.S.C. 154(b) by 0 days.

(21) Appl. No.: 09/232,757

(22) Filed: Jan. 15, 1999

Related U.S. Application Data

(63) Continuation-in-part of application No. 09/008,757, filed on Jan. 19, 1998.

(51) Int. Cl.[7] ..... H01R 4/24; H01R 4/26; H01R 11/20

(52) U.S. Cl. ..... 439/404; 439/405

(58) Field of Search ..... 439/404, 405, 439/608, 49, 532

(56) References Cited

U.S. PATENT DOCUMENTS

| | | | | |
|---|---|---|---|---|
| 5,160,273 A | | 11/1992 | Carney | |
| 5,226,835 A | * | 7/1993 | Baker, III et al. | 439/403 |
| 5,324,211 A | | 6/1994 | Siemon et al. | |
| 5,328,380 A | | 7/1994 | Carney | |
| 5,494,461 A | | 2/1996 | Bippus et al. | |
| 5,591,045 A | * | 1/1997 | Pepe et al. | 439/460 |
| 5,601,447 A | * | 2/1997 | Reed et al. | 439/404 |
| 5,772,472 A | * | 6/1998 | Beutelr et al. | 439/608 |
| 5,941,734 A | * | 8/1999 | Ikeda et al. | 439/676 |
| 6,113,418 A | * | 9/2000 | Kjeldahl | 439/405 |

FOREIGN PATENT DOCUMENTS

| | | |
|---|---|---|
| JP | 1-82350 | 4/1992 |
| JP | 182350 | 4/1992 |

* cited by examiner

*Primary Examiner*—Brian Sircus
*Assistant Examiner*—Chandrika Prasad
(74) *Attorney, Agent, or Firm*—Cantor Colburn LLP

(57) ABSTRACT

A wiring connecting system having superior electrical transmission performance with reduced cross talk and improved lacing and termination features is disclosed and includes a base, a wire strip mountable to the base, a connecting block for housing a plurality of electrical contacts and a plurality of cross talk barriers disposed within the connecting block for isolating pairs of the electrical contacts. The wire strip has a plurality of first and second posts alternating along its length. The second posts have a greater width than the first posts. A connecting block for housing a plurality of electrical contacts mounts onto the wire strip. An upper end of the connecting block includes a plurality of first and second teeth alternating along its length with the second teeth have a greater width than the first teeth. The electrical contacts extend from the lower end of the housing to generally align with the openings of the wire strip. A plurality of barriers for electrically shielding pairs of the electrical contacts are disposed within the connecting block housing and substantially surround respective pairs of the electrical contacts. A plug for connecting a cable having a plurality of wires to the connecting block is also disclosed.

5 Claims, 20 Drawing Sheets

HIGH PERFORMANCE WIRING CONNECTING SYSTEM

CROSS REFERENCE TO RELATED APPLICATIONS

This application is a continuation-in-part of U.S. patent application Ser. No. 09/008,757 filed Jan. 19, 1998.

BACKGROUND OF THE INVENTION

1. Field of the Invention

This invention relates generally to telecommunication wiring systems for use in the communications industry. More specifically, this invention relates to an improved wiring connecting system having superior electrical transmission performance with reduced cross talk and improved lacing and termination features.

2. Prior Art

Prior art wire connecting systems or wiring blocks are well known and commercially available from AT&T, now Lucent Technologies, Inc., as the 110 connector system. The 110 wire connecting systems are described in several patents including U.S. Pat. Nos. 3,611,264, 3,798,581 and 4,118,095. The 110 type wiring block comprises a base having a plurality of legs at each end thereof. The legs provide a space behind the wiring block (when mounted) for cables that are to be terminated on the wiring block. The wiring block includes a base having a plurality of spaced longitudinal slots. A wiring strip is secured to the base within the slots by a plurality of posts. Connector blocks having Insulation Displacement Contacts (IDC's) housed within are mounted on the wire strips. Wires terminated at 110 wiring blocks may be terminated at the wiring strips and at the connector blocks for electrical contact with the IDC's of the connector blocks. The use of IDC's in which the wires are punched into the IDC maximizes density and facilitates ease of use. Various improvements to such 110 connector systems have been made since their initial development, including the feature of using detachable legs, as described in U.S. Pat. No. Re. 35,030.

In a typical wiring application, backbone cabling (such as from outside a building or from a main bus within the building to a particular floor) is terminated at a primary distribution point where 110 wiring blocks are employed. Horizontal cabling from various end-user equipment or communications networking, e.g. computers, phones, networks and the like, is also terminated at the distribution point at 110 wiring blocks. The 110 type connecting systems are designed to support digital data transmission as well as analog/digital voice over unshielded twisted pair (UTP) media through the use of wiring blocks, connector blocks and patch cords or jumpers. This system facilitates moves, additions and rearrangements of circuits connected to end-users or equipment to provide a flexible means of connecting horizontal and backbone cabling within a building.

With increased rates of transmission, a higher performance wiring block is needed to minimize near end transmission cross talk between IDC pairs. The problem of cross talk is not very severe at low frequencies (around 16 MHZ), however, as the rate of transmission increases up to 400 MHZ, the radiation is higher and there is a greater need to reduce this cross talk. Prior art attempts to reduce this cross talk have utilized conductive shields (plates) between pairs. U.S. Pat. Nos. 5,160,273, 5,324,211 and 5,328,380 are examples of the use of such plates. However these prior art attempts do not surround and/or isolate the IDC pairs and thus reduction of cross talk is not optimized. Another limitation of these prior art devices is that difficulty is encountered when lacing and punching down twisted pair wiring. The tips of the 110 type blocks between the IDC pairs are typically blunt and require untwisting of the wire prior to lacing into the block. This leads to excessive untwist in the pair and loss of electrical performance. Thus, there is a need in the industry for an improved wiring connecting system having superior electrical transmission performance with reduced cross talk and improved lacing and termination features.

SUMMARY OF THE INVENTION

The above-discussed and other drawbacks and deficiencies of the prior art are overcome or alleviated by the wiring connecting system of the present invention. In accordance with the present invention, a wiring connecting system having an improved wire strip, connecting block, and cross-talk barrier is disclosed. The wiring connecting system includes a base, a wire strip mountable to the base, a connecting block for housing a plurality of electrical contacts and a plurality of cross talk barriers disposed within the connecting block for isolating pairs of the electrical contacts.

The wire strip has a plurality of first and second posts alternating along its length. The second posts have a greater width than the first posts. The first posts and second posts define an opening to receive a wire therebetween. A connecting block for housing a plurality of electrical contacts mounts onto the wire strip. The connecting block is made of an insulative material and includes opposed sidewalls and opposed upper and lower ends. The upper end includes a plurality of first and second teeth alternating along its length. The second teeth have a greater width than the first teeth. A space is provided between the teeth to receive a wire. The electrical contacts are partially disposed within the space and extend from the lower end of the connecting block to generally align with the openings of the wire strip. A plurality of barriers for electrically shielding pairs of the electrical contacts are disposed within the connecting block housing and substantially surround respective pairs of the electrical contacts.

In a preferred embodiment, the barriers include depending legs which seat within the second posts of the wire strip. The barriers may also include extending arms which nestle within the second teeth of the connecting block.

A plug for connecting a cable having a plurality of wires to the connecting block is also disclosed in accordance with the present invention. The plug includes a housing having a first end, a second end and a hollow interior. The first end has a hole to receive the cable and the second end has a plurality of openings which are generally aligned with the spaces between the first and second teeth of the connecting block so that the electrical connectors disposed within the housing interior can electrically connect to the electrical contacts housed within the connecting block when the plug is mounted to the connecting block. In another embodiment the electrical connectors are either J shaped or C shaped to reduce transmission loss within pairs of the electrical connectors. A shield may be disposed on a side of the plug to alter the magnetic fields associated with the wire contact pairs to further reduce cross-talk.

DETAILED DESCRIPTION OF THE DRAWINGS

Figure 1:
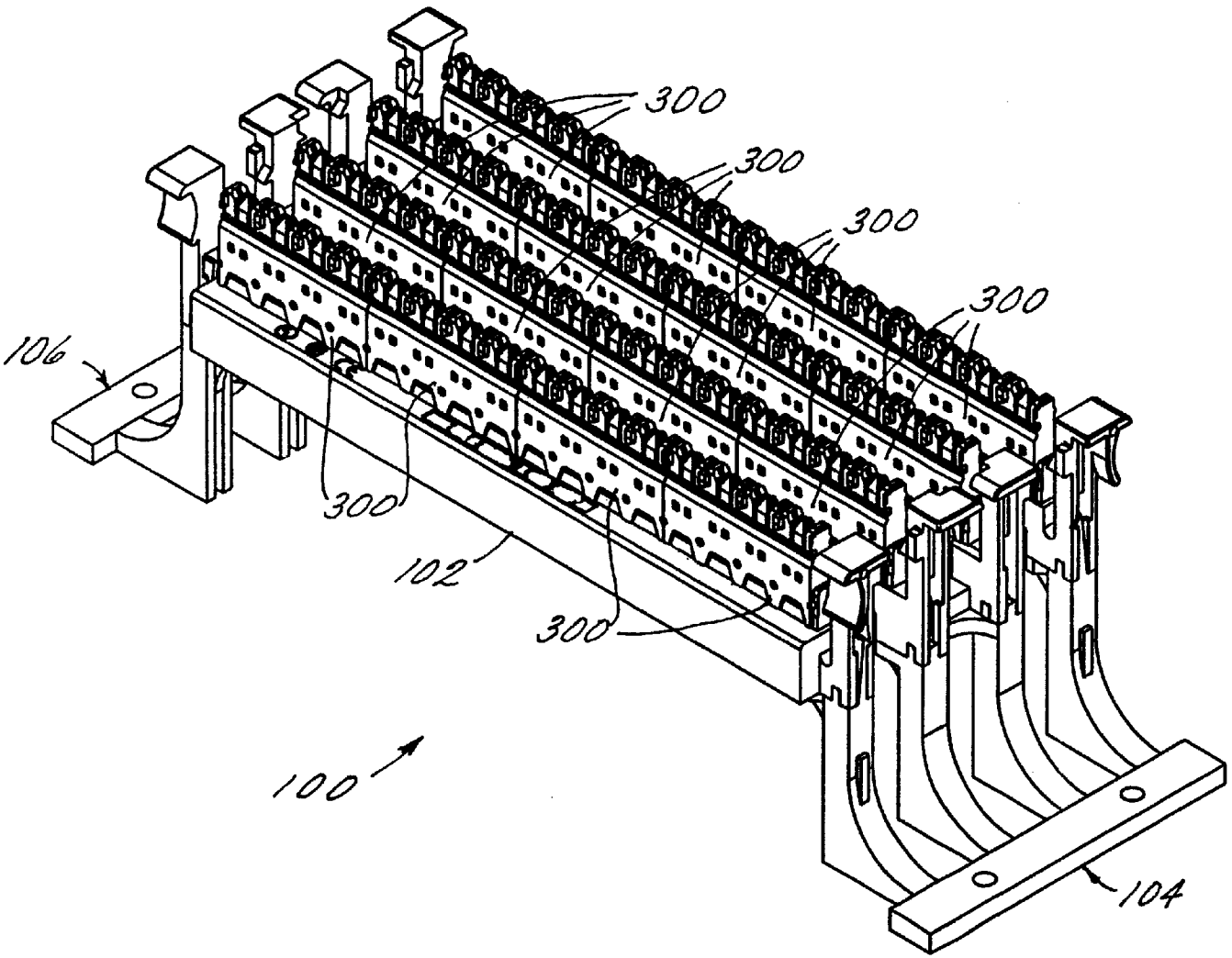
FIG. 1 is a perspective view of a wiring connecting system in accordance with the present invention.
Figure 2:
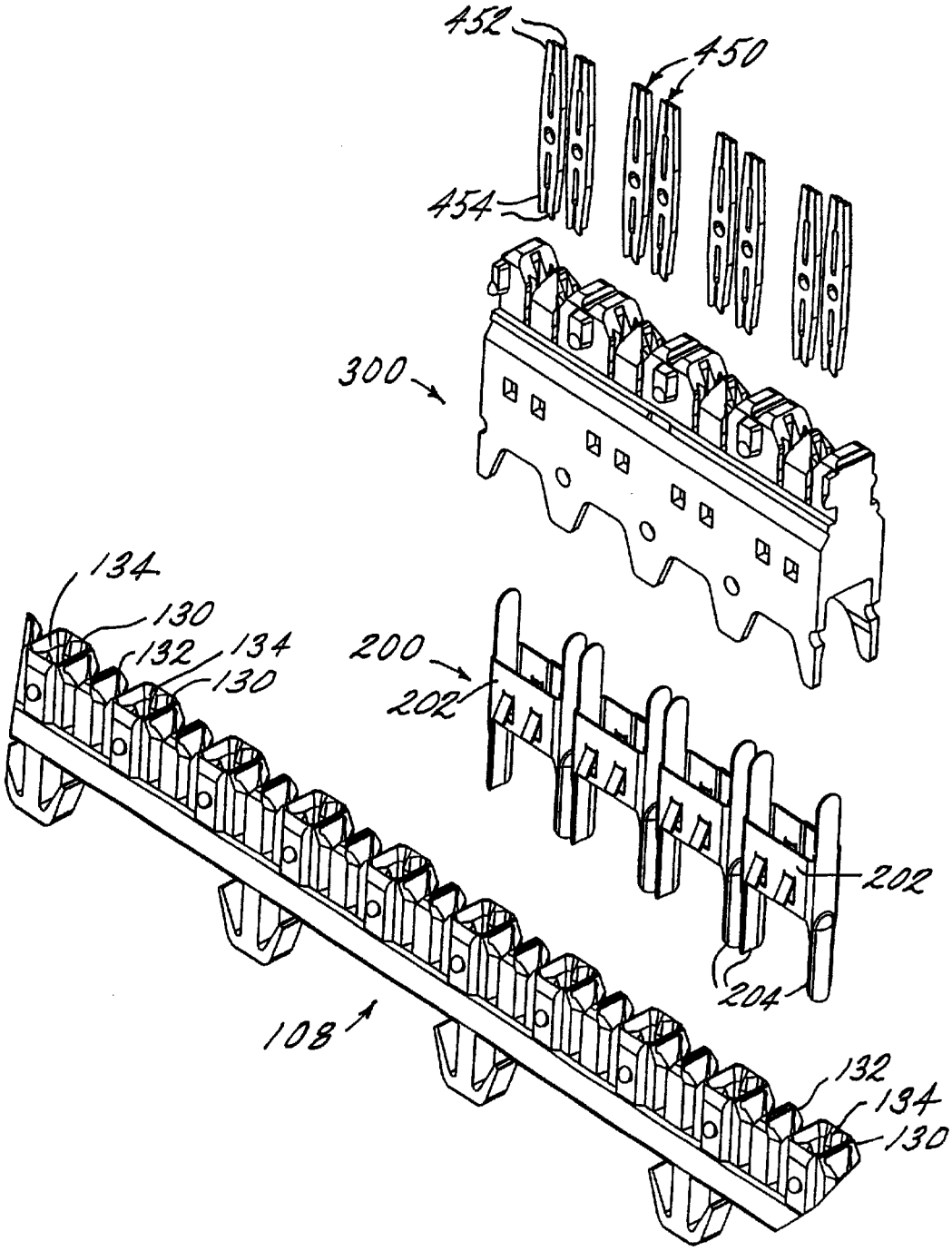
FIG. 2 is an exploded assembly view of a connecting block, a wire contact, a cross talk barrier and a wire strip, for use in the wiring connecting system of FIG. 1 in accordance with the present invention.
Figure 3:
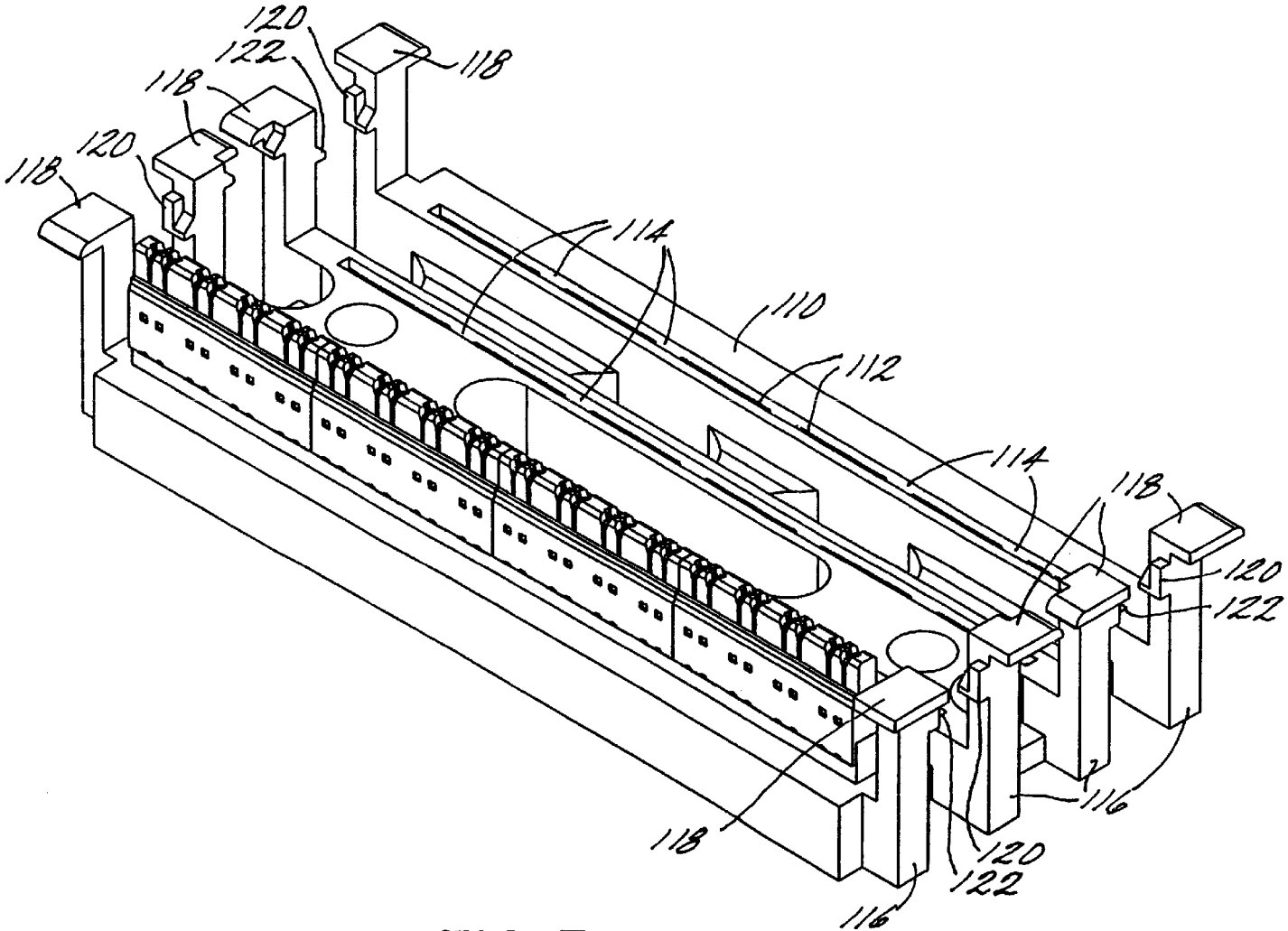
FIG. 3 is a perspective view of the connector blocks mounted to a base of the wiring connecting system of FIG. 1.

Referring now to FIGS. 1 through 3, a wiring connecting system in accordance with a preferred embodiment of the invention is generally shown at 100. Wiring connecting system includes base 102 having a first leg assembly 104 and a second leg assembly 106 at its ends. Wire strips 108 are mounted to the upper surface 110 of base 102. Upper surface 110 of base 102 has U-shaped channels 112, each having a plurality of rectangular openings 114. Upright members 116 extend upward from base 102 and terminate in flat surfaces 118. Latching protrusions 120 and 122 engage respective leg assemblies 104 and 106 to allow the leg assemblies to be removably attached as described in more detail in U.S. Pat., Re. 35,030, incorporated herein by reference.

Wire strips 108 include posts 124 having a pair of resilient arms 126 extending therefrom. Posts 124 depend from longitudinal rail 128 of wire strip 108 and are inserted into rectangular openings 114 to secure wire strip 108 to base 102. Resilient arms 126 are compressed and then return to their original position after posts 124 are inserted into openings 114. Wire strip 108 includes a plurality upwardly extending posts in the form of divider post 130 and middle post 132 which are disposed between respective divider posts 130. Divider posts 130 have a subdivided opening 134. As described in more detail below, wires terminated at wiring block 100 are disposed on each side of a respective middle post 132 to form a wire pair. Divider posts 130 have a greater width than middle posts 132 so that there is greater separation between respective wire pairs than between the wires which form the pair. Cross talk barriers 200 include a generally hollow rectangular body 202 with lower depending legs 204 and upwardly extending arms 206. Barrier 200 is made of an electrically conductive material with suitable shielding properties. Preferably, barriers 200 are made of metal. Legs 204 insert into respective subdivided openings 134 of divider posts 130 so that respective bodies 202 of barriers 200 surround the area extending above respective middle posts 132.

Connector blocks 300 have a generally insulative body 302 and mount on to wiring strip 108. Barrier bodies 202 are disposed within connector block 300 when connector block 300 is mounted to wire strip 108. Connector block 300 includes center teeth 304 and barrier teeth 306 with a channel slot 308 therebetween. Wire contacts 450 are disposed in respective channel slots 308 between center teeth 304 and barrier teeth 306. Wire contacts are preferable insulation displacement contacts such as those described in U.S. Pat. No. 4,964,812 incorporated herein by reference. Wires terminated at wiring block 100 are connected at connector block 300 by press fit into wire contacts 450. Each wire of a wire pair is disposed on one side of a respective center tooth 304. As described in more detail below, barrier teeth 306 have a greater width than center teeth 304 so that there is greater separation between respective wire pairs than between the wires which form the pair. Each connector block 300 includes depending sides 310 which receive wiring strip 108 therebetween. Arms 206 of barriers 200 extend into respective barrier teeth 306 when connector blocks 300 are mounted to respective wiring strips 108 so that wire contacts 450 are essentially surrounded within respective barrier bodies 202. Thus in use, wire contacts 450 are surrounded by cross talk barriers 200 to reduce cross talk between wire pairs.

Figure 4:
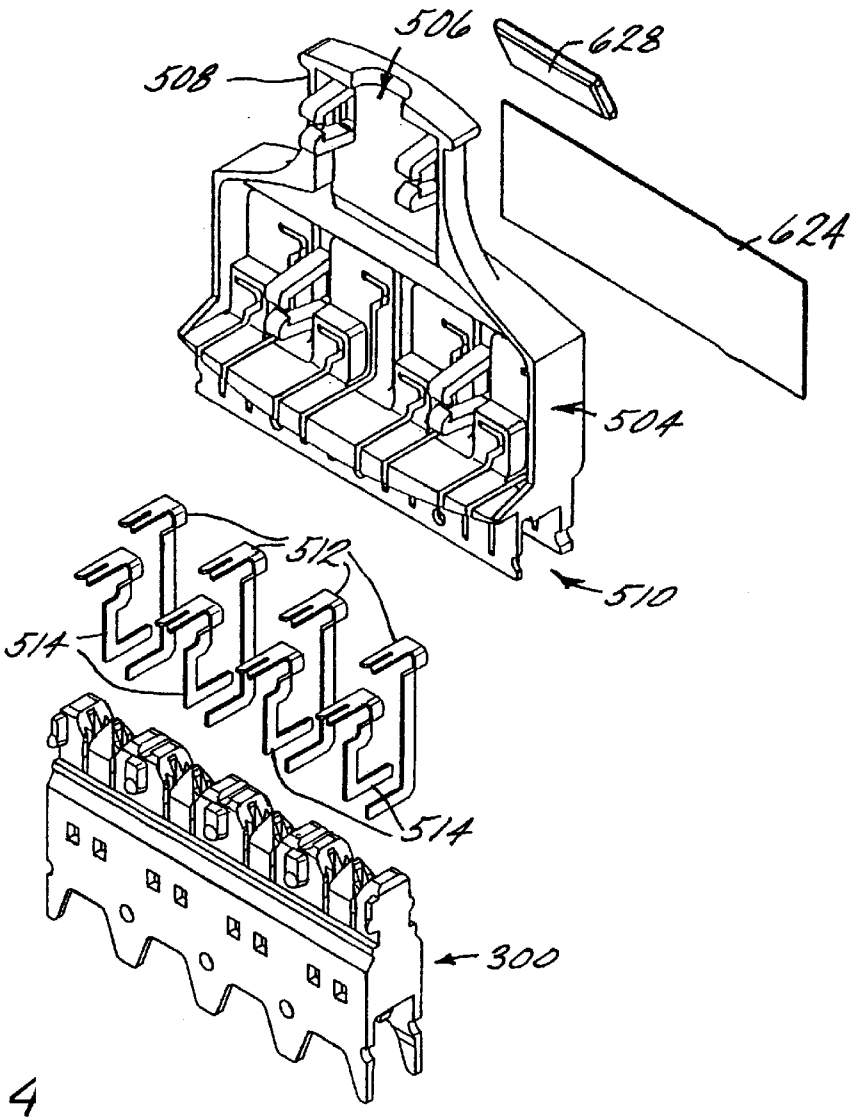
FIG. 4 is an assembly view of a plug in accordance with the present invention positioned over the connecting block of FIG. 2.
Figure 4:
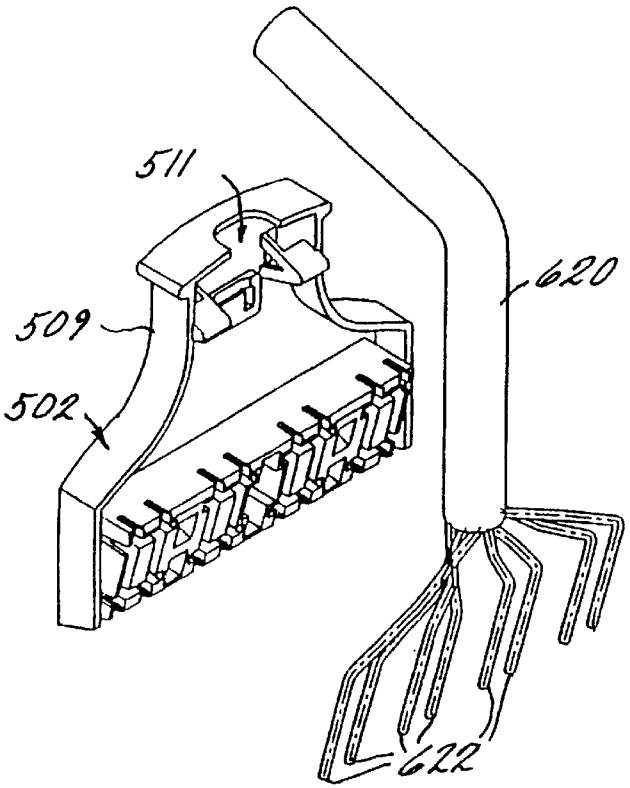
Figure 5:
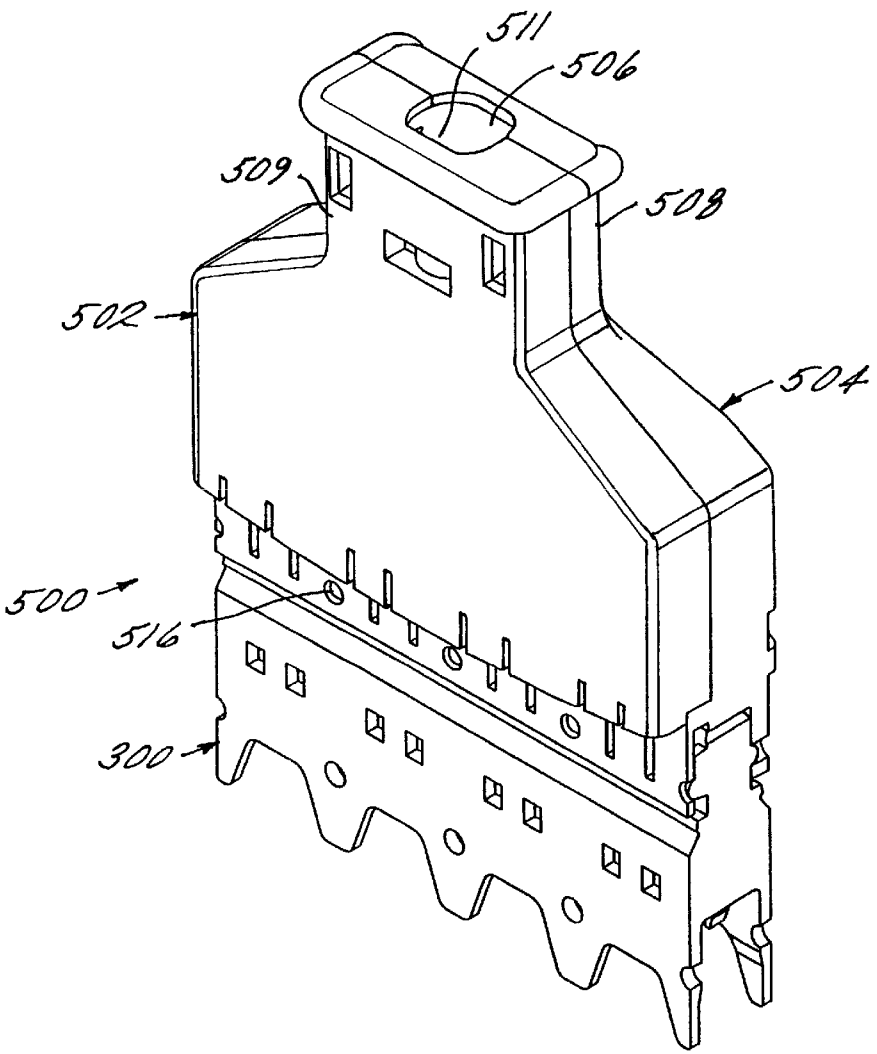
FIG. 5 is a perspective view of the plug of FIG. 4.

Referring now to FIGS. 4 and 5, an interface plug for use with wiring connecting system 100 in accordance with the present invention is generally shown at 500. Plug 500 includes a generally insulative hollow body comprising first and second housing portions 502 and 504 with respective openings 506 and 511 in handle portions 508 and 509 to receive a cable 620 of wires 622. Plug 500 includes U-shaped plug end 510. Disposed within plug 500 are first and second contacts 512 and 514. Contacts 512 and 514 extend from plug 500 at plug end 510 and are spaced in pairs to mate with respective contacts 450 disposed on each side of a respective center tooth 304 of a connector block 300. A cable of wires is disposed through openings 506 and 511 and each wire is electrically connected to respective contacts 512 and 514 in wire pairs. As described in more detail below, the geometries of the respective contacts 512 and 514 provide for reduced cross talk within each pair by reducing the proximity of the contacts with respect to each other. In use contacts 512 and 514 make electrical contact with wire contacts 450 when plug 500 is mounted to connector block 300 on wiring block 100. Plug also includes shield 624 to contain magnetic fields generated by contacts 512 and 514. Icon 628 allows a user to identify the plug 500.

Figure 6:
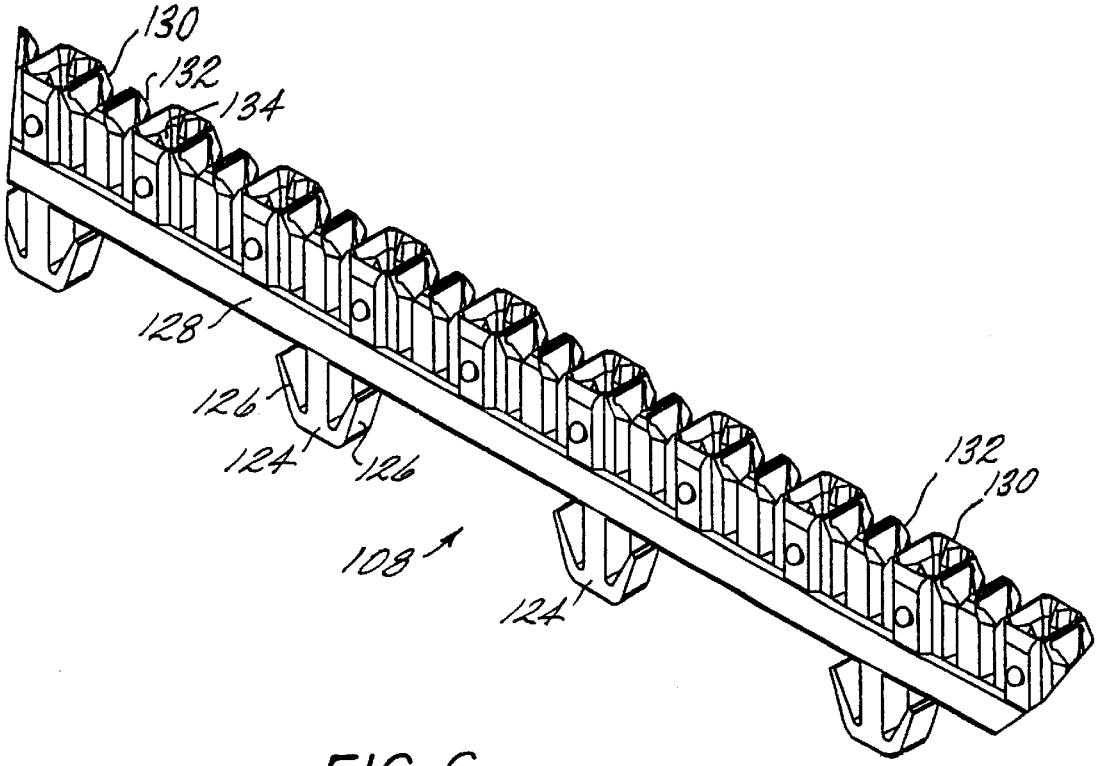
FIG. 6 is a perspective view of a wire strip for use in the wiring connecting system of FIG. 1 in accordance with the present invention.
Figure 7:
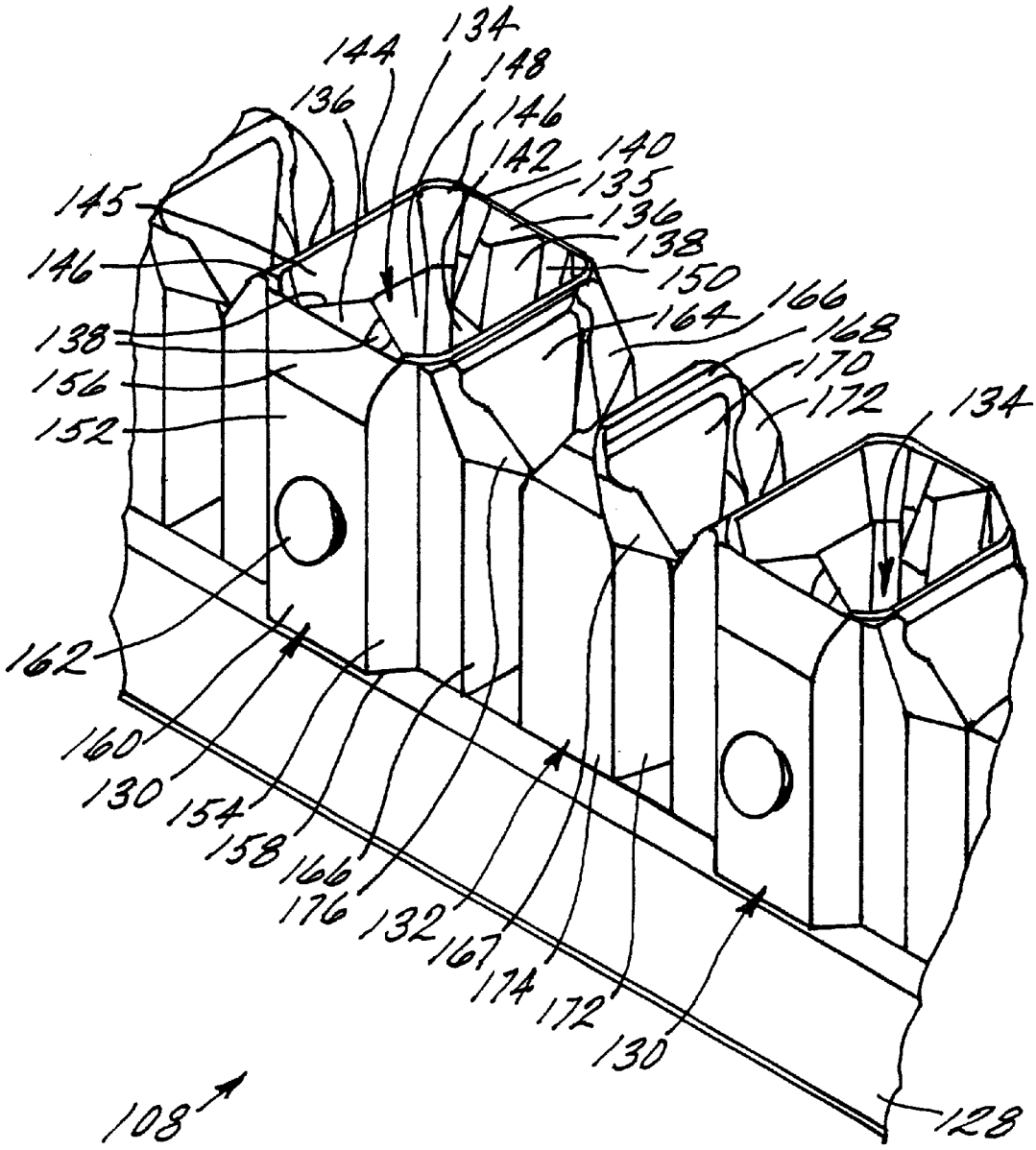
FIG. 7 is a perspective view of the posts of the wiring strip of FIG. 6.

Referring now to FIGS. 6 and 7, a detailed discussion of wire strip 108 follows. Wire strip 108 includes a longitudinal rail 128 having a plurality of divider posts 130 and middle posts 132 extending upward therefrom and is made of an insulative material, preferably plastic, such as polycarbonate. Each divider post 130 is generally rectangular with a subdivided opening 134 at its top 135. Wall protrusions 136 are disposed on the interior surface 150 of each sidewall 152. Wall protrusions 136 have side angled surfaces 138 which join a top angled surface 140 at the top 135 of divider post 130. Angled surfaces 138 and 140 extend down to the generally rectangular wall protrusion body 142. Sidewalls 152 and end walls 144 join at rounded corner 146. In this manner, depending legs 204 of adjacent cross talk barriers 200 are received within opening 134 and retained in spaced apart arrangement by the wall protrusions 136. Each side wall 152 has a top angled surface 156, side angled surfaces 154 and a bottom angled surface 158 which extend outward and join at external sidewall surface 160. Cylindrical protrusions 162 extend outward from external side wall surfaces 160 (on both sidewalls). As shown in FIG. 2, connector block 300 has a plurality of openings 312 in which cylindrical protrusions 162 nestle to allow connector block 300 to removably attach to wire strip 108, preferably by snap fit. Each end wall 144 has an angled top wall surface 145, an interior wall surface 148 and an exterior wall surface 164. Projecting wall portions 166 extend outward from external wall surface 164 at an acute angle. Each middle post 132 has an I-shaped top portion 168. Extending from each end wall 170 are projecting wall portions 172 which project inward at an acute angle. Each middle post 132 includes opposed side walls 174. Wires to be terminated at wire strip 108 are disposed on each side of a respective middle post 132 to form a wire pair. Wires are retained between projecting respective wall portions 166 of divider posts 130 and respective projecting walls 172 of middle posts 132. Projecting wall portions 166 and 172 have respective angle surfaces 167 and 176. Locking nubs (not shown) may be disposed on either of the projecting walls 166 and 172 to additionally assist retention of wires between respective projecting walls 166 and 172.

Figure 8:
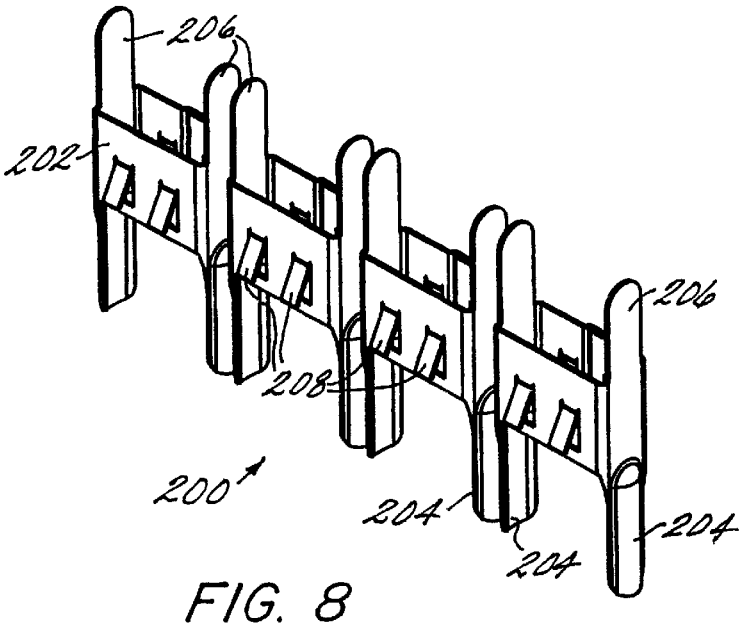
FIG. 8 is a perspective view of a cross talk barrier in accordance with the present invention.

Referring to FIG. 8, cross talk barriers 200 are made of a conductive material with suitable shielding characteristics, preferably metal, and comprise rectangular body portions 202 having depending legs 204 and extending arms 206. Legs 204 and arms 206 are preferably flat. Tabs 208 disposed on side walls 210 extend outward and engage rectangular openings 314 of connector block 300 when cross talk barrier is disposed within connector block 300. In this manner barriers 200 are retained within connector block 300. Legs 204 insert into respective subdivided openings 134 of divider posts 130 so that respective bodies 202 of barriers 200 surround the area extending above respective middle posts 132. Arms 206 of barriers 200 extend into respective barrier teeth 306 when connector blocks 300 are mounted to respective wiring strips 108 so that wire contacts 450 are essentially surrounded within respective barrier bodies 202.

Referring to FIGS. 9 and 10*a* –10*e*, a detailed discussion of connecting block 300 follows. Connector block 300 includes a generally hollow rectangular insulative body 302 (preferably made of polycarbonate) having a plurality of center teeth 304 and barrier teeth 306 (with channel slots 308 therebetween) running the length of its upper surface 309. Center teeth 304 and barrier teeth 306 are also generally rectangular and hollow. Barrier teeth 306 have a greater width than center teeth 304. Teeth 304 and 306 stagger in width so that respective wire pairs (disposed on each side of the center teeth 304) are separated by barrier teeth 306 having a greater width than the center teeth 304. Depending sides 310 extend from the lower U-shaped channel 316 disposed at bottom 318 of connector block 300. Each barrier tooth 306 has a center slot 320 and a retaining protrusion 322 with a circular extension 324 extending from front outer side wall 326. Circular extensions 324 engage openings 516 of plug 500 (see FIG. 5) to provide a defeatable attachment. Inner wall 328 includes circular extensions 330. Barrier teeth 306 include upper surface 332, front angled surface 334, rear angled surface 336 and side angled surfaces 338. Slots 340 are formed in barrier teeth end walls 342. Center teeth 304 include top surface 344, front angled surface 346, rear angled surface 348 and side angle surfaces 350. Slots 352 in center teeth end walls 354 and slots 340 in barrier teeth end walls 342 form wire contact retaining channel slots 356 where wire contacts 450 are retained. Spaces 308 between center teeth 304 and barrier teeth 306 allow wires to be disposed between center teeth 304 and barrier teeth 306 and inserted in wire contacts 450. Sides 310 include lower portions 358. Sides 310 are rounded 360 at the junction of sides 310 and bottom end wall 362. Inner protrusions 364 allow sides 310 to defeatably attach connector block 300 onto wiring strip 108. Front body wall 368 and rear body wall 370 have respective angled surfaces 372 and 374 adjacent protrusions 376 and 378. Arms 206 of cross talk barrier 200 are seated within respective barrier teeth 306 so that body 202 of cross talk barrier 200 generally surrounds the center portions of the wire contacts 450 when block 300 is mounted to wire strip 108. Tabs 208 of cross talk barrier 200 seat within rectangular openings 314 of body 302 to reduce cross talk barrier 200 within connector block 300 when assembled.

Figure 9:
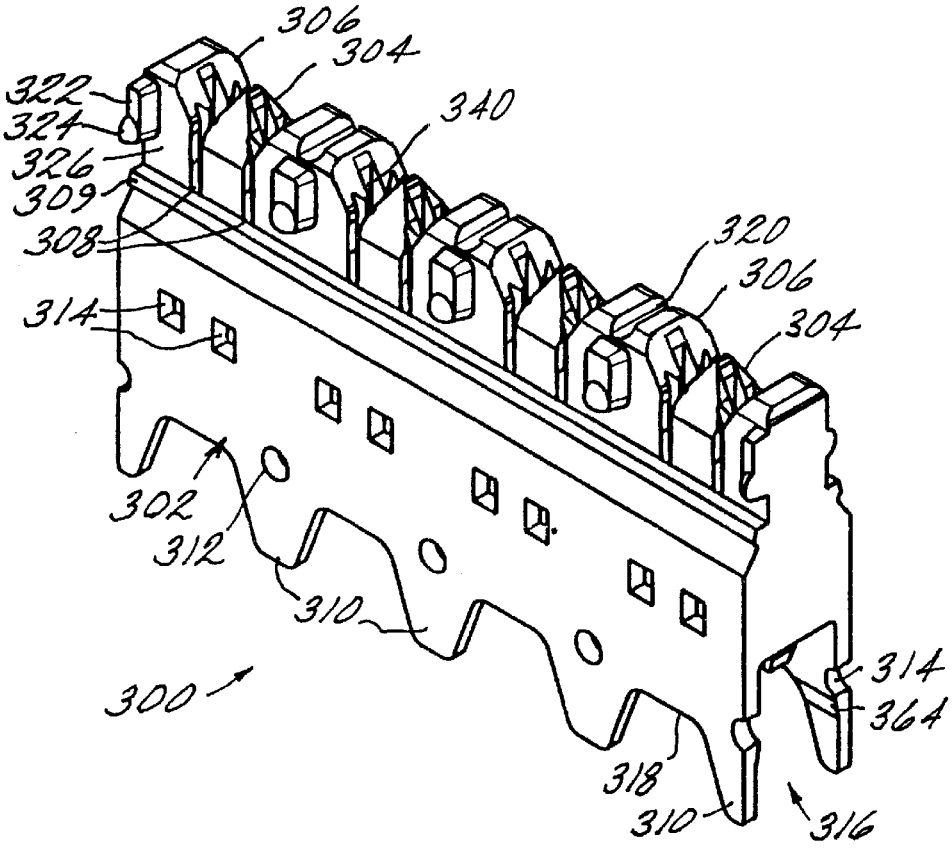
FIG. 9 is a perspective view of a connecting block in accordance with the present invention.
Figure 10B:
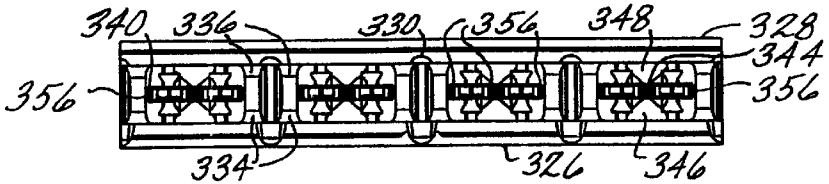
FIG. 10*b* is a top view of a connector block having cross talk barriers and wire contacts assembled therein in accordance with the present invention.
Figure 10A:
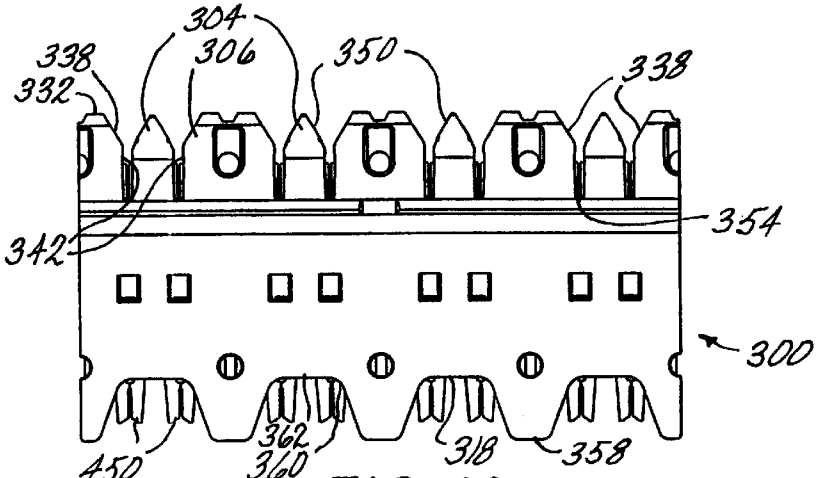
FIG. 10*a* is a front view of a connector block having cross talk barriers and wire contacts assembled therein in accordance with the present invention.
Figure 10E:
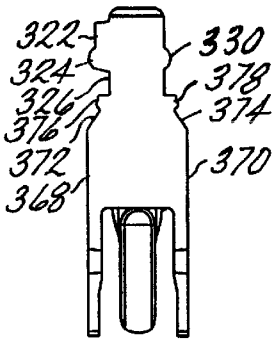
FIG. 10*e* is a right side view of a connector block having cross talk barriers and wire contacts assembled therein in accordance with the present invention.
Figure 10C:
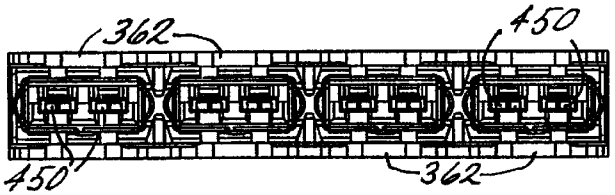
FIG. 10*c* is a bottom view of a connector block having cross talk barriers and wire contacts assembled therein in accordance with the present invention.
Figure 10D:
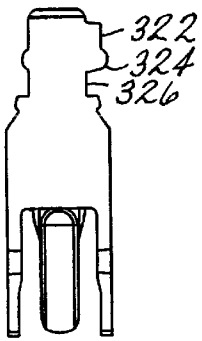
FIG. 10*d* is a left side view of a connector block having cross talk barriers and wire contacts assembled therein in accordance with the present invention.

As also shown in FIG. 9, retaining protrusions 322 with a circular extensions 324 extend only from respective front outer side walls 326. This feature allows mating connectors, such as plug 500, or adapters to be polarity sensitive and to engage connector block 300 in one orientation to prevent connection when a connector is not properly orientated with respect to polarity.

Referring again to FIGS. 1 and 2, in use, a user may mount wiring block 100 on a flat surface, such as a wall, and terminate backbone or horizontal cabling to the wire strip 108 by pressing each wire between respective divider posts 130 and middle posts 132. Legs 204 of cross talk barriers 200 are seated in subdivided openings 134 of divider posts 130 so that respective bodies 202 of cross talk barriers 200 are disposed above middle posts 132. Thus, wire contacts 450, when inserted into slots 356 of connector block 300 are essentially centered within cross talk barriers 200 in pairs when connector block 300 is mounted to wire strip 108. In this manner, wire pairs connected to wire contact 450 pairs have shielding essentially on all sides. Moreover, the greater width of divider posts 130 reduces cross talk by increasing the space between respective wire pairs. It will be appreciated by those skilled in the art from reading this discussion that the precise geometries of the cross talk barrier 200 may be varied so long as the wire pairs and associated wire contacts 450 are essentially surrounded on all sides when connector block 300 is mounted to wire strip 108 and greater distance is provided between pairs.

Figure 11:
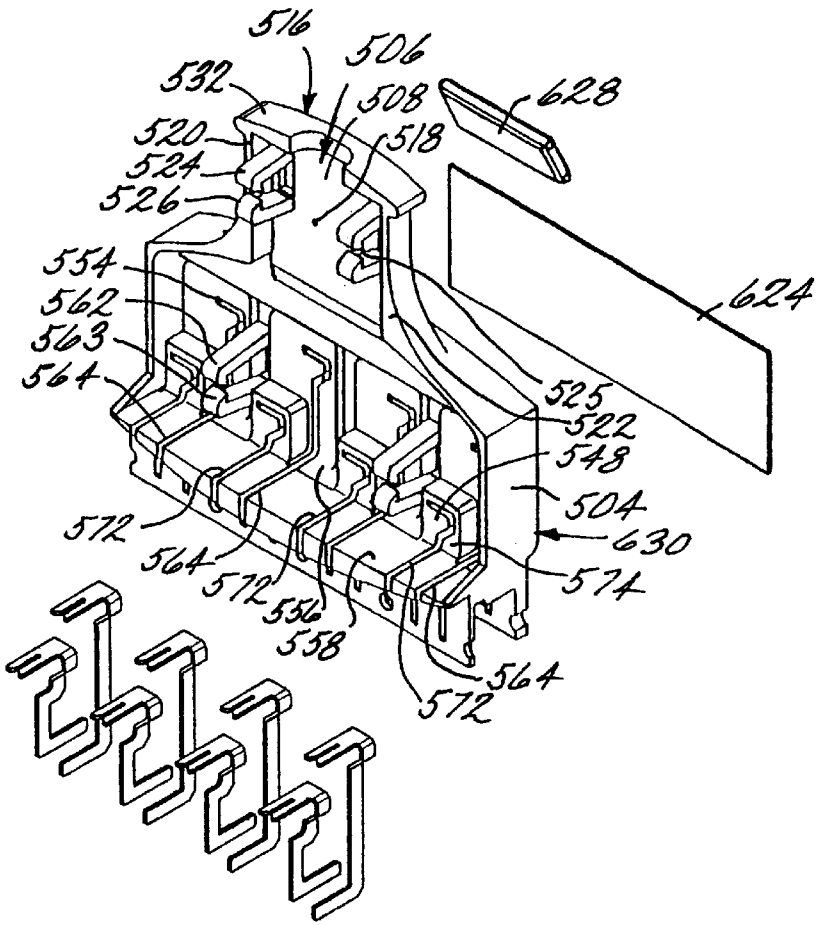
FIG. 11 is an exploded assembly view of the plug for use with the connecting block.
Figure 11:
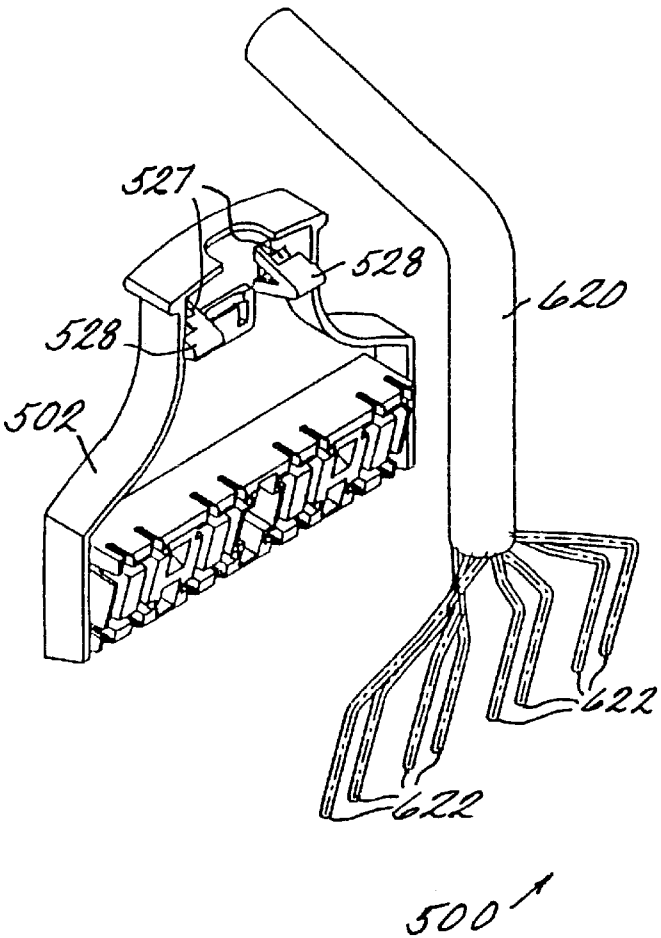
Figure 12:
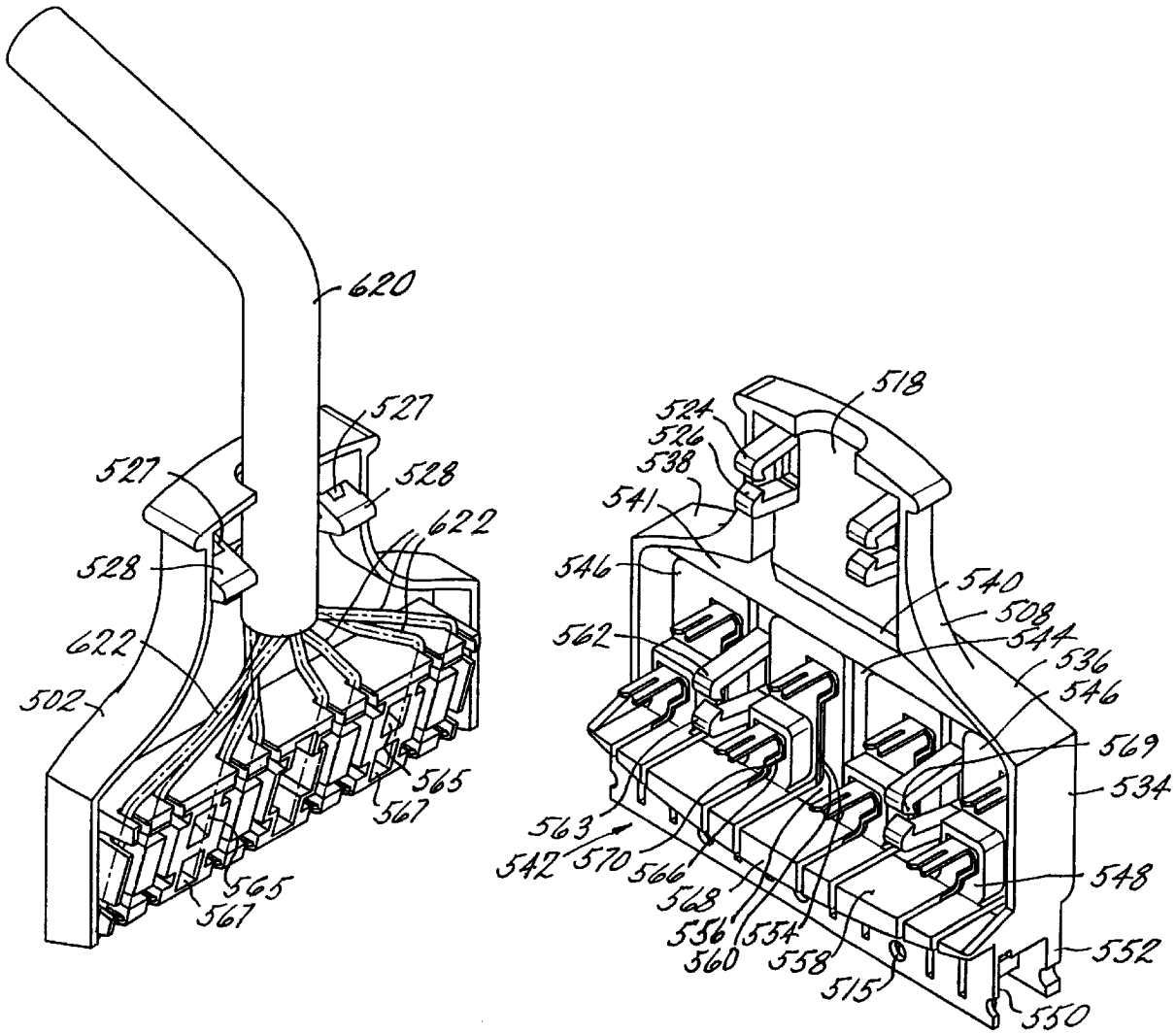
FIG. 12 is an exploded assembly view of the plug.
Figure 13B:
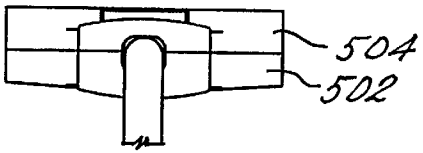
FIG. 13*b* is a top view of the plug.
Figure 13A:
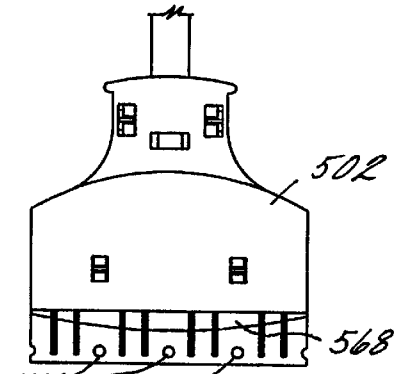
FIG. 13*a* is a front view of the plug.
Figure 13C:
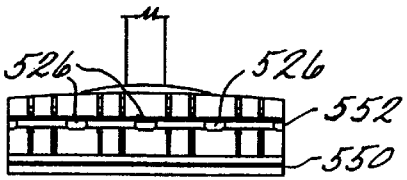
FIG. 13*c* is a bottom view of the plug.
Figure 13D:
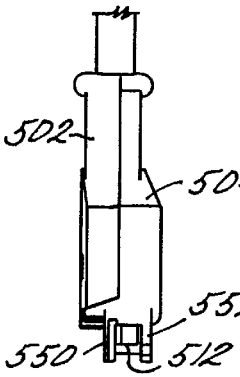
FIG. 13*d* is a right side view of the plug.
Figure 13E:
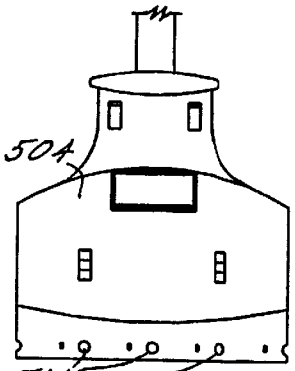
FIG. 13*e* is a back view of the plug.
Figure 13F:
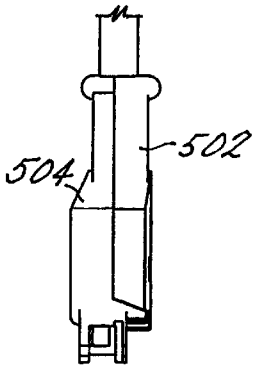
FIG. 13*f* is a left side view of the plug.

Turning now to FIGS. 11 and 12, plug 500 comprises two housings 502 and 504 of a generally insulative material, such as plastic. Housing 504 has a handle portion 508. Handle portion 508 of housing 504 includes handle outer and inner surfaces 516 and 518, handle end walls 520 and 522, a pair of resilient locking arms 524 and 526, and handle top wall 532. Resilient arms 524 and 526 have locking nubs 525 and receive locking protrusions 528 of housing 502 between respective arms 524 and 526. Locking nubs 525 are nestled within openings 527 to provide a secure attachment of respective housings 502 and 504. Handle 508 of housing 504 tapers to a main body portion 534 at connecting walls 536 and 538. Inner surface 518 extends downward to edge 540 of intermediate portion 541 which forms the top of contact retention cavity 542 in main body portion 534. Contact retention cavity 542 includes inner wall surface 544, first contact support surface 546 and second contact support surface 548 which terminate at legs 550 and 552. Contact support surface 546 is disposed on inner wall surface 544 and has contoured slots 554 which retain contacts 512. Contact support surface 546 includes a rounding portion 556 which joins lower wall 558 of contact retention cavity 542. Contoured slots 554 have vertical portions 560 and terminate in lower wall slots 564. A second pair of resilient arms 562 and 563 are disposed within cavity 542 and seat within a pair of respective openings 565 and 567 of housing 502 to hold the housings 502 and 504 together. Locking nubs 569 provide a latching feature. Second contact support 548 is raised from first contact support 546 and has shorter contoured slots 566 having vertical portions 570 which terminate in lower wall slots 572 of lower wall 558. The first contact supports 546 lie in a first plane and the second contact supports 548 lie in a second plane which reduces crosstalk between adjacent contacts. Second contact support surface 548 also includes a rounded portion 574 as it joins lower wall 558. As shown in FIGS. 13*a*–13*f*, and described in more detail below, when contacts 512 and 514 are disposed into respective contoured slots 554 and 566, contacts 512 and 514 sufficiently protrude from lower wall 558 of housing 504 so that they may be electrically connected, such as by insertion to wire contacts 450 disposed in connector block 300. Rounded projecting portion 568 extends outward from leg 550 and covers the wire ends when housings 502 and 504 are assembled.

Figure 14:
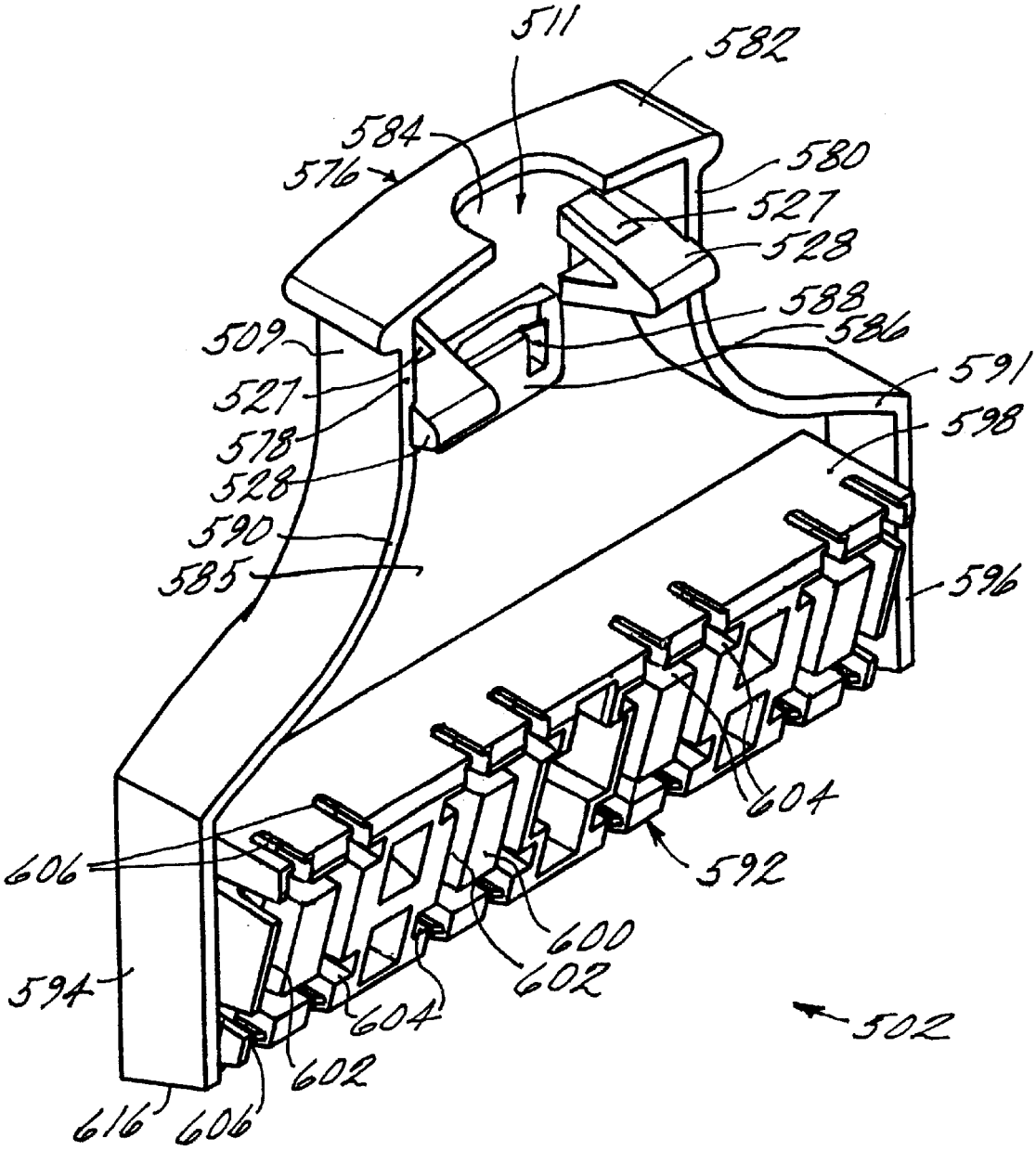
FIG. 14 is a perspective view of one of two housing halves of the plug of FIG. 12.

Referring now to FIG. 14, housing 502 includes handle portion 509 having an opening 511, exterior wall surface 576, end walls 578 and 580, top wall 582 and side wall 584. Cable retention surface 586 is raised from inner wall surface 585 and has rectangular openings 588 for receiving a cable strap (not shown) to retain a wire cable. Protrusions 528 protrude from inner wall surface 585 and lodge between locking arms 524 and 526 when housing 502 and 504 are attached to each other and serve to defeatably attach housings 502 and 504. Protrusions 528 have openings 527 to receive locking nubs 525 on each side. Handle ends walls 578 and 580 join taper wall portions 590 and 591 which in turn join plug end walls 594 and 596 to contain contact retention block 592. Contact retention block 592 has an upper surface 598, a taper side wall 600 and a plurality of contact retention slots 602 and 604 and is attached to inner surface 585. Contact retention slots 602 are vertically aligned and parallel with respect to each other. Contact retention slots 604 are horizontal and parallel and positioned in crosswise fashion to contact retention slots 602. Contact retention slots 602 have nubs 606 facing each other at both ends of retention block 592 to retain respective wires placed into slots 602. In this manner assembly is easily facilitated as wires are laced in slots 602 and terminated by respective contacts 512 and 514 when housings 502 and 504 are assembled.

Referring again to FIGS. 13*a* through 13*f*, polarity slots 526 are disposed on leg 550 at plug end 510 to receive respective extensions 322. Cylindrical protrusions 324 (shown in FIG. 9) are seated in holes 516. Leg 552 does not have polarity slots 526 so plug 500 can only mount onto block 300 in one direction which achieves polarity.

Figure 15:
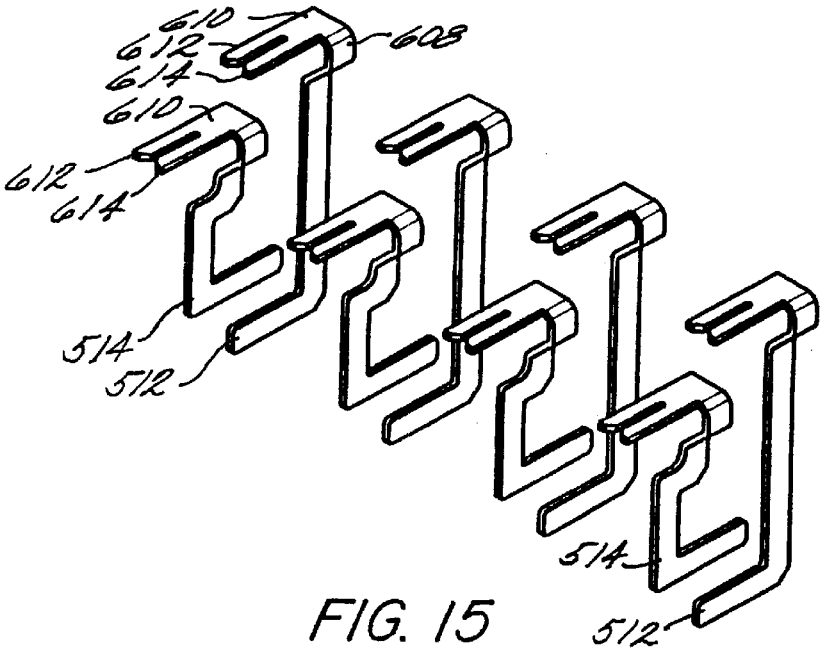
FIG. 15 is a perspective view of contacts used in the plug in accordance with the present invention.

As shown in FIG. 15, contact 512 comprises an elongated J shaped plate member having a curved-shaped portion 608 disposed at its top. A wire retention clip 610 is connected to curved-shaped portion 608 having forcations 612 and 614. Contact 514 comprises a C-shaped plate member having an elbow connected to its curved-shaped portion 608 also having wire retention clip 610 with forcations 612 and 614. Wires to be terminated within plug 500 are laced in slots 602 and are terminated between forcations 612 and 614 when housings 502 and 504 are assembled. When housings 502 and 504 are assembled, wire clips 610 nestle into respective slots 604 when housing 502 is mounted to housing 504. Housing 502 further includes angled end portion 616 in end wall 594 which receives lower wall 558 of housing 504.

Thus in use, plug 500 is assembled by inserting contacts 512 and 514 into respective contoured slots 554 and 566 so as to protrude from lower wall surface 558 of housing 504. A cable 620 having wires 622 is terminated by lacing respective wires 622 in respective slots 602 and then into wire clips 610 of contacts 512 and 514 by insertion between forcations 612 and 614 when housings 502 and 504 are fitted together, thus decreasing assembly time and facilitating ease of use. The wires 622 are clipped along angled end portion 616 so that the wire ends are covered by rounded projecting portion 568 to provide a neat appearance. Openings 506 and 511 allows cable to exit plug 500. A cable strap may be inserted in rectangular openings 588 to secure the wire cable so that in use stress is not applied to contacts 512 and 514. Housing 502 is mounted to housing 504 so that resilient arms 524 and 526 receive protrusions 528 therebetween and resilient arms 562 and 563 are received in openings 565 and 567. Clips 610 nestle in slots 604 when housings 502 and 504 are attached. Contacts 512 and 514 are spaced apart in pairs. The distance between respective pairs is greater than the distance between two contacts of a pair to provide reduction of crosstalk between pairs. Further, the contour of contacts 512 and 514 in the respective J-shape and C-shape reduces the area of overlap within pair of contacts which enhances cross talk reduction between pairs. The upper portion of C-shaped contact 514 is shorter than its base to further reduce overlap (and thus cross talk is reduced between pairs). The position of slots 564 and 566 in housing 504 allows for greater insulative material (plastic) to surround each respective contacts 512 and 514 to maximize the distance between adjacent contacts within two pairs resulting in a reduction in cross talk involving the pairs. Plug 500 removably attaches to connector block 300 by the insertion of the exposed portions of contacts 512 and 514 into wire clips 450. Cylindrical protrusions 324 nestle within holes 516 to allow plug 500 to defeatably lock on to connector block 300. Plug end walls 550 and 552 are preferably resilient and receive teeth 304 and 306 therebetween. It will be apparent to those of ordinary skill in the art based on this disclosure that the number of wire pairs may be varied (e.g., 2 pair, 3 pair, 4 pair, etc.).

Referring again to FIG. 11, plug 500 may also include an electrically conductive shield 624 and an icon 628 disposed on housing back 630 of housing 504. Shield 624 further reduces cross talk by providing isolation from varying magnetic fields between pairs produced by RF currents traveling within contacts of a pair. Shield 624 also provides isolation from varying magnetic fields between pairs which results in enhanced cross talk reduction between these pairs. Shield 624 is preferably made of metal. Icon 628 allows a user to mark plug 500 for identification, e.g. computer, telephone, etc. Icon 628 may include an integrally molded symbol and is preferably made of plastic.

Figure 16:
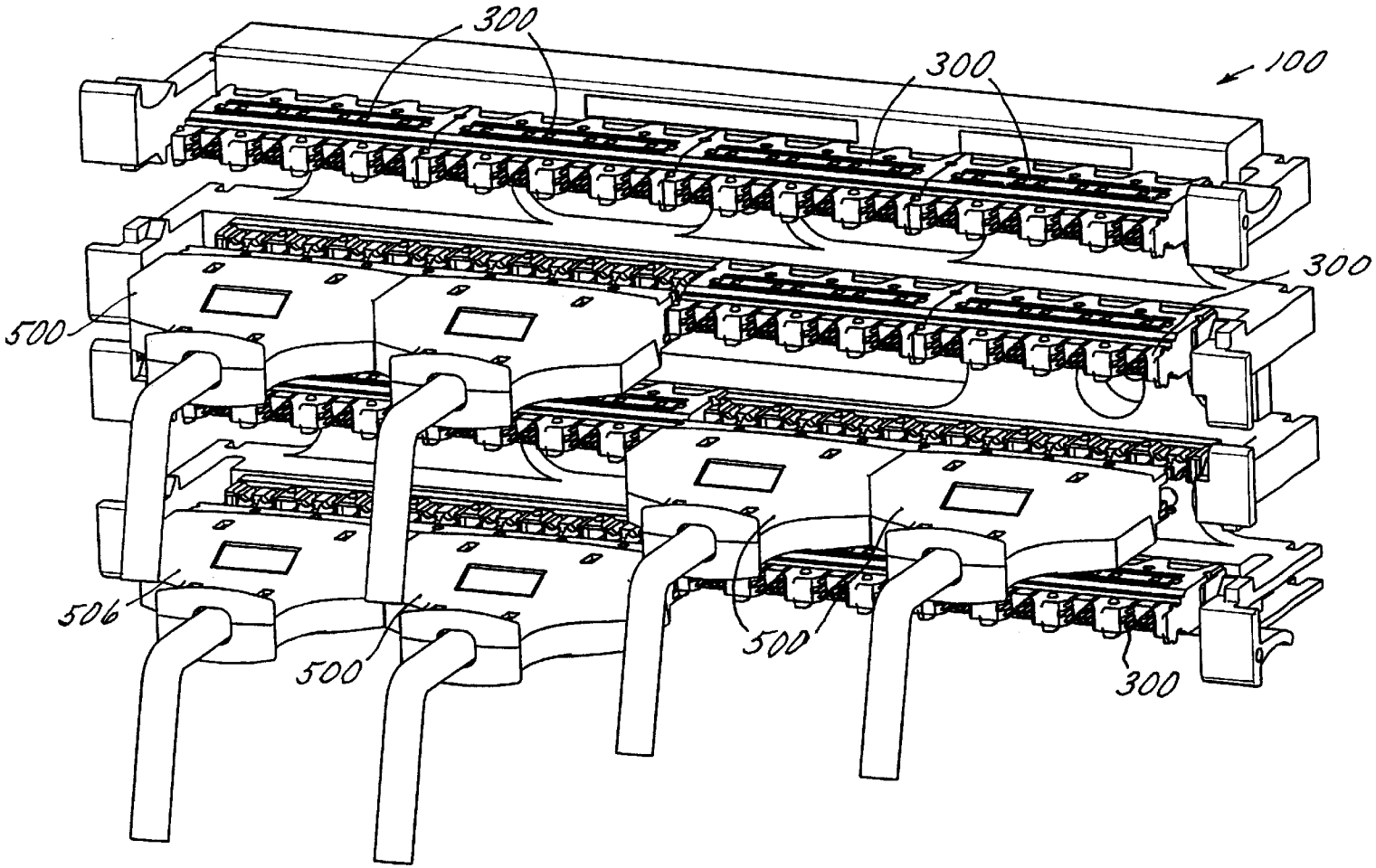
FIG. 16 is a perspective view of a plurality of plugs mounted to a plurality of connecting blocks of the wire connecting system.

As shown in FIG. 16, any number of wiring strips 108 may be employed with the appropriate base 102. Further, any number of connector blocks 300 may be employed with appropriate wire strips 108. Plugs 500 may be plugged onto blocks in varying combinations to achieve desired electrical connections within wiring connecting systems and/or between wiring connecting systems.

Figure 17:
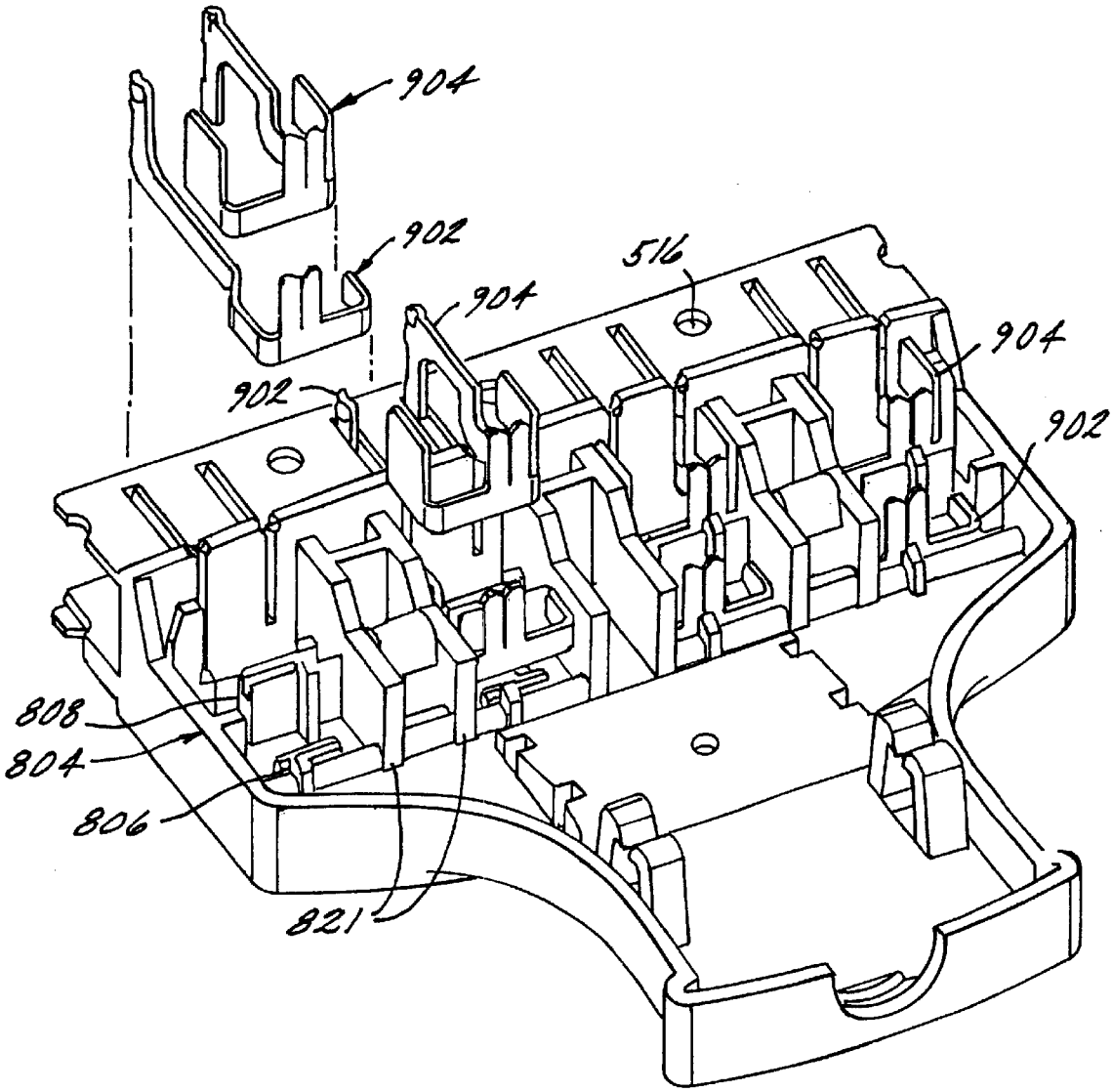
FIG. 17 is a partially exploded, perspective view of a housing of an alternative plug.
Figure 23:
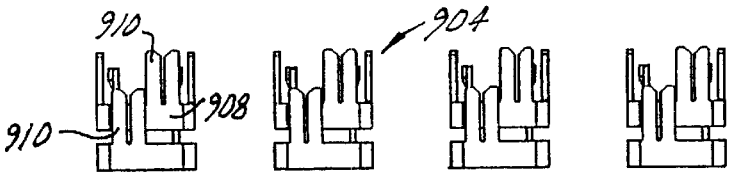

FIG. 17 is a partially exploded, perspective view of an alternative plug housing 84. Plug housing 804 is similar to plug housing 504 and receives contacts 902 and 904. First contact 902 is positioned at a first contact support 806. Second contact 904 is positioned at a second contact support 808. The first contact support 806 has a pair of spaced apart, generally parallel walls 810 and 812 (FIG. 21) which define a channel therebetween for receiving base 906 (FIG. 23) of first contact 902. The second contact support 808 has a pair of spaced apart, generally parallel walls 814 and 816 (FIG. 21) which define a channel therebetween for receiving base 908 (FIG. 23) of second contact 904. The first contact support 806 and the second contact support 808 are at different heights. This locates the base of each of the first contacts 902 in a first plane and the bases of the second contact 904 in a second plane. By staggering the contacts in this fashion, crosstalk may be reduced and performance enhanced. Adjacent each first contact support 806 and each second contact support 808 is a support wall 821. The support wall 821 provides stability to arms extending from the base of each contact as described herein.

Wall 812 includes a protrusion 813 extending beyond wall 812 and having an angled face 815 facing wall 814. Angled face 815 facilitates installation of contact 902 in contact support 806. Similarly, wall 816 includes a protrusion 817 extending beyond wall 816 and having an angled face 819 facing wall 818. Angled face 819 facilitates installation of contact 904 in contact support 808. Protrusions 813 and 817 are also located so as to be aligned with the insulation displacement portions 910 of contacts 902 and 904. Protrusions 813 and 817 help to position wires in the housing 504.

As described above with respect to housing 504, the first contact 902 and second contact 904 are grouped in pairs such that the distance between two pairs is greater than the distance between contacts in a pair. Contact 902 and 904 are positioned in housing 804 as described above with reference to housing 504. Housing 804 includes holes 516 that such as described above with reference to housing 504. Contacts 902 have the J-shaped end and contacts 904 have the C-shaped end as described above.

Figure 18:
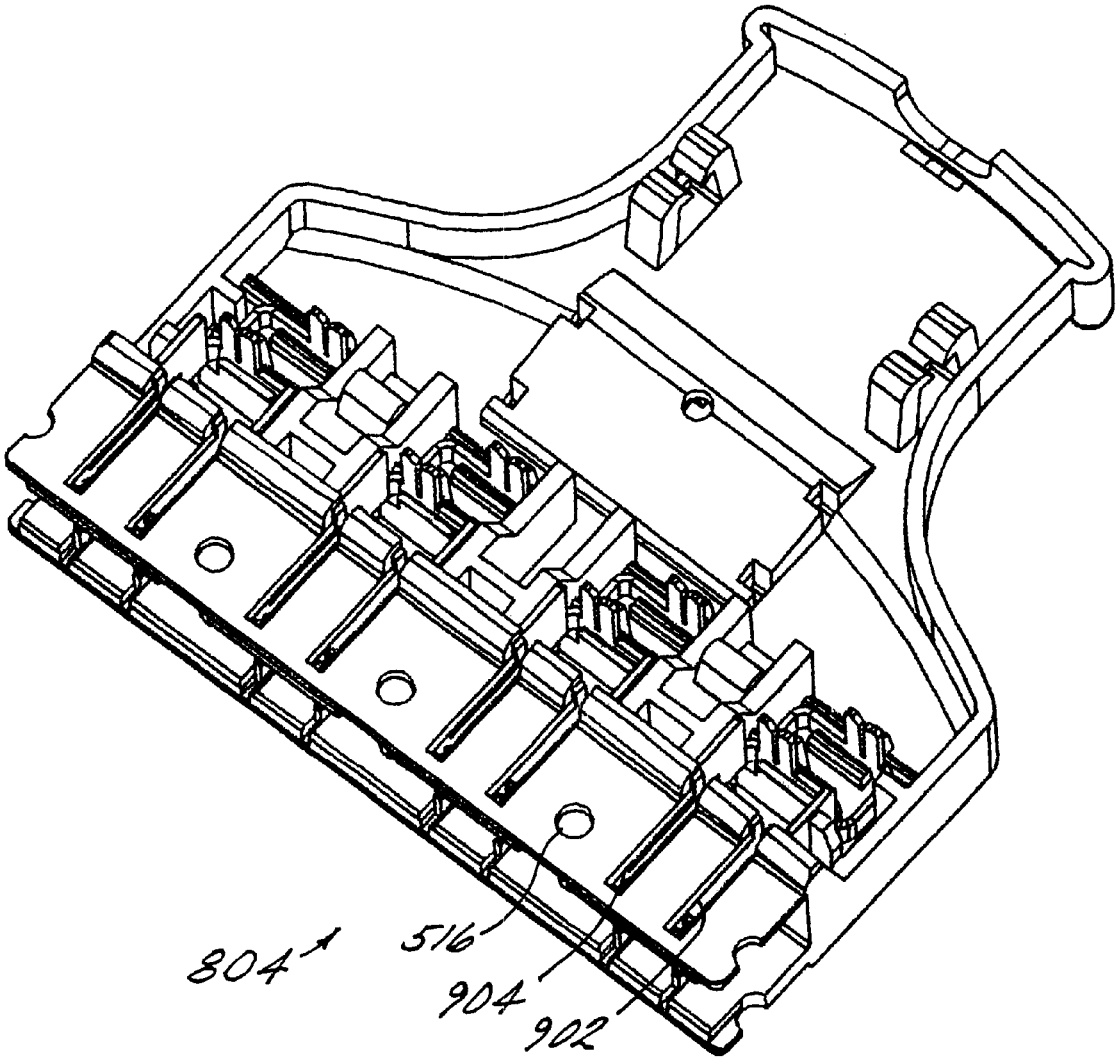
FIG. 18 is a perspective view of the housing with contacts.
Figure 19:
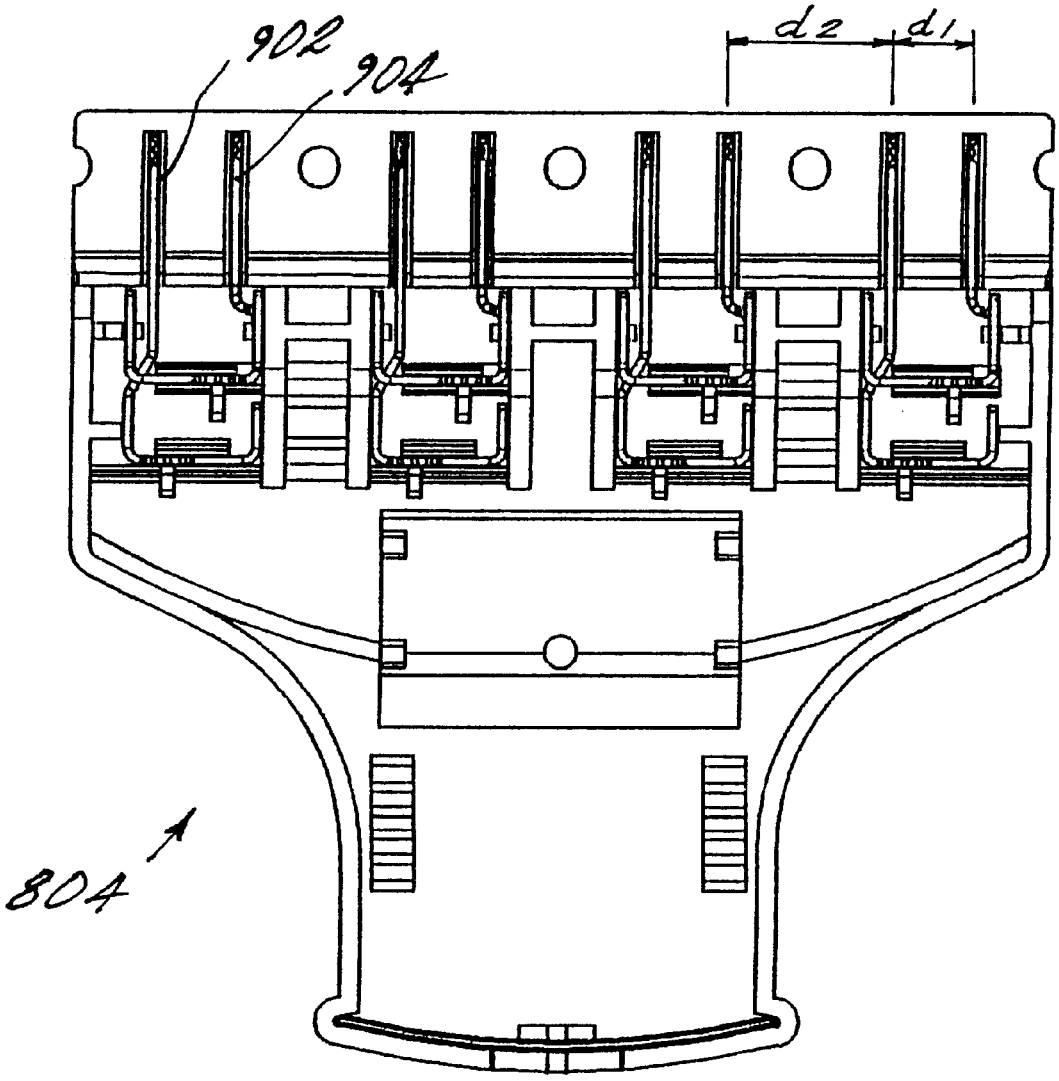
FIG. 19 is a top view of the housing with contacts.
Figure 20:
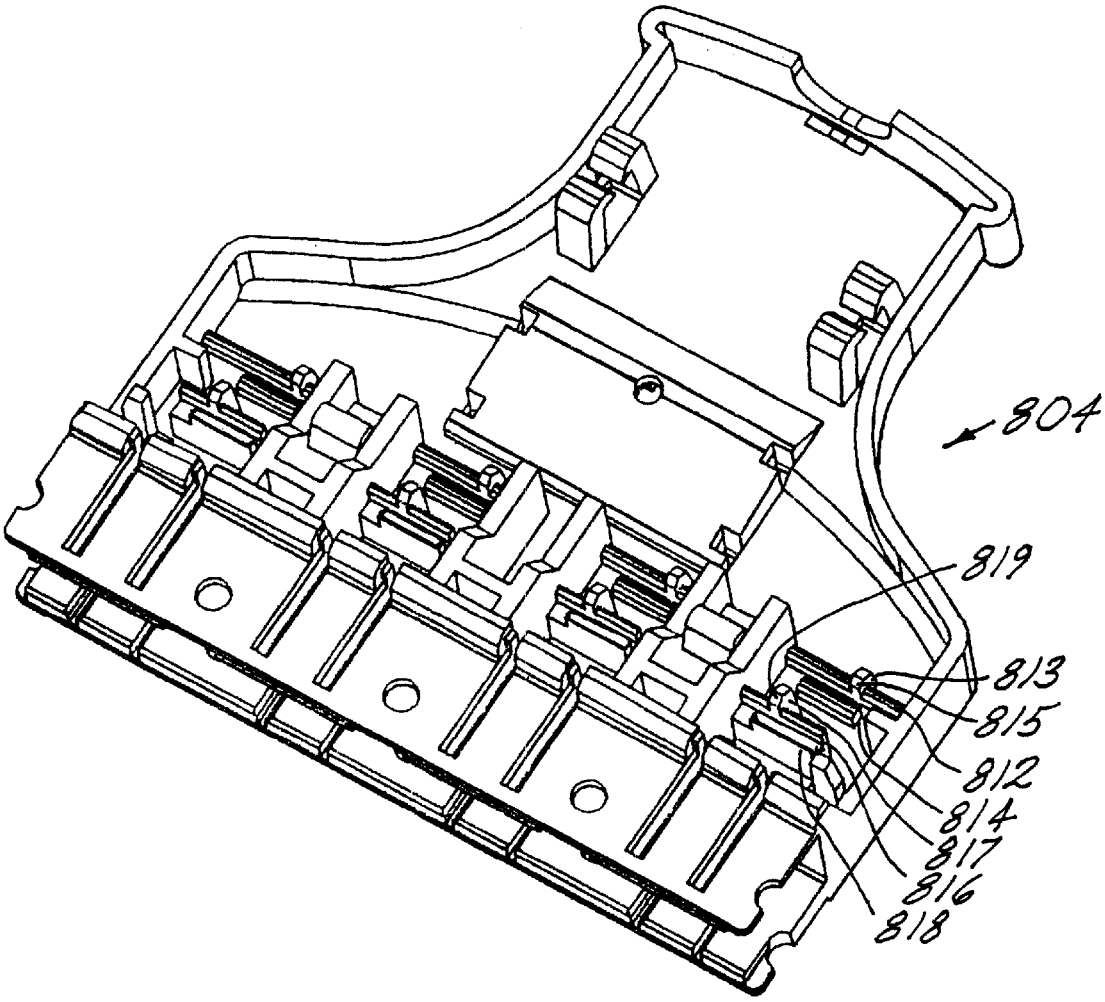
FIG. 20 is a perspective view of the housing without contacts.
Figure 21:
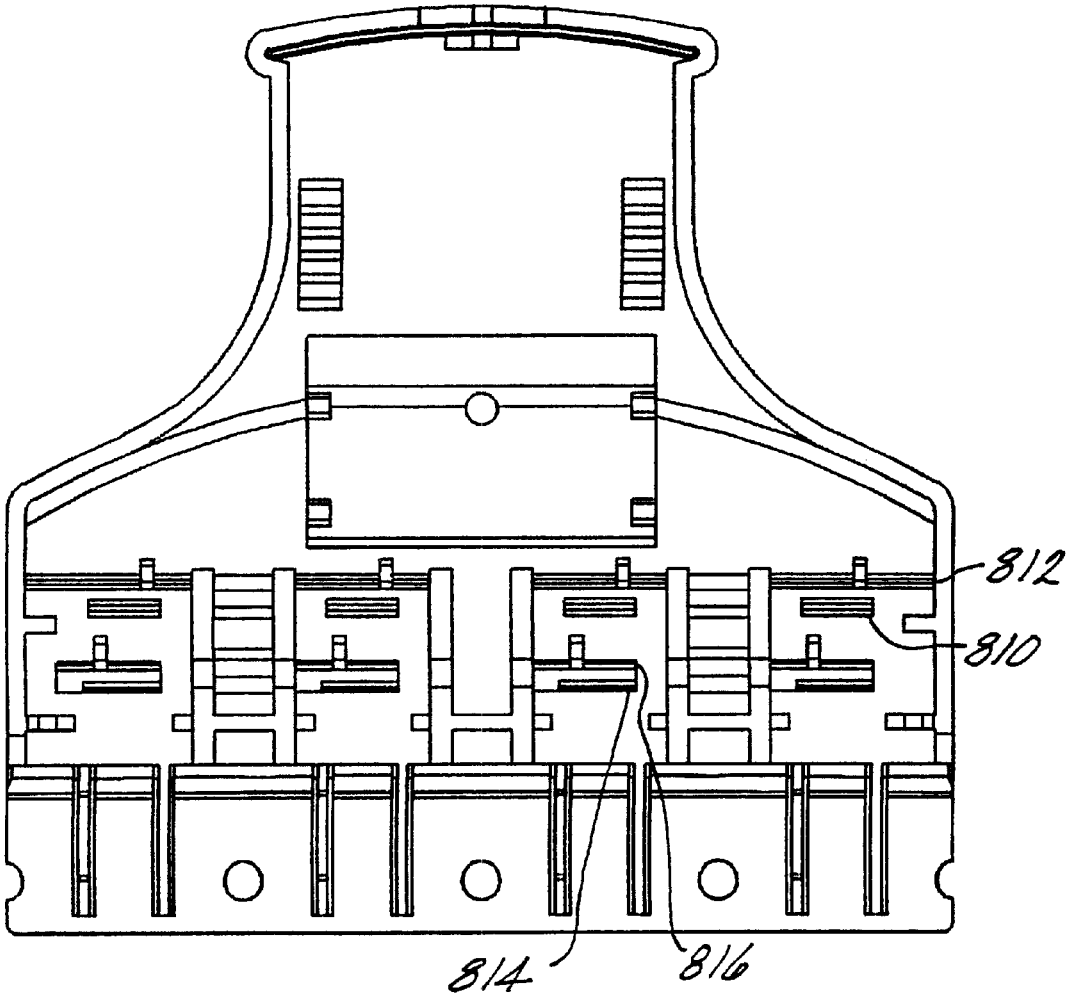
FIG. 21 is a top view of the housing without contacts.
Figure 24:
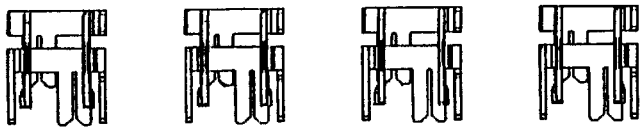
FIGS. 22–26 are views of the contacts for use with the alternate housing.
Figures 22, 25, 26:
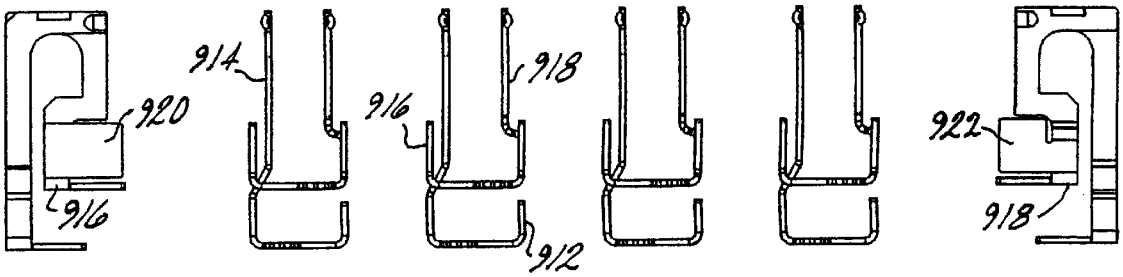

FIG. 18 is a perspective view of housing 804 with contacts 902 and 904 mounted therein. FIG. 19 is a top view of housing 804 with contacts 902 and 904 mounted therein. The distance d1 between first and second contacts of a pair is less than the distance d2 between adjacent pairs. FIG. 20 is a perspective view of housing 804 without contacts and FIG. 21 is a top view of housing 804 without contacts.

FIGS. 22–26 are views of the contacts for use with housing 804. First contact 902 includes a generally rectangular base 906 having an insulation displacement portion 910 extending therefrom. An arm 912 is located at a first end of base 906 and is substantially perpendicular to base 906. At a second end of base 906 is contact arm 914 which is generally perpendicular to base 906. Contact arm 914 has a J-shaped distal portion as described above with reference to contact 512.

Second contact 904 includes a generally rectangular base 908 having an insulation displacement portion 910 extending therefrom. An arm 916 is located at a first end of base 908 and is substantially perpendicular to base 908. At a second end of base 908 is contact arm 918 which is generally perpendicular to base 908. Contact arm 918 has a C-shaped distal portion as described above with reference to contact 514. Arm 916 includes a rectangular plate 920 and contact arm 918 includes rectangular plate 922.

Arm 912 of contact 902 is positioned close to contact arm 914 in an adjacent contact 912. The proximity of arm 912 and contact arm 914 between first contacts 902 creates reactance (i.e. capacitance and/or inductance) between two adjacent first contact 902. As is known in the art, this type of reactive coupling counteracts crosstalk and enhances performances. Similarly, plate 920 on arm 916 is positioned close to plate 922 on contact arm 918 of adjacent second contacts 904. The proximity of plate 920 and plate 922 between second contacts 904 creates reactance (i.e. capacitance and/or inductance) between two adjacent second contacts 904. As is known in the art, this type of reactive coupling counteracts crosstalk and enhances performances.

While the preferred embodiments have been shown and described, various modifications and substitutions may be made thereto without departing from the spirit and scope of the invention. Accordingly, it is to be understood that the present invention has been described by way of illustration and not limitation.

What is claimed is:

1. A telecommunications plug comprising:

a housing; and a plurality of contacts positioned in said housing, each of said contacts having a termination end, said contacts including a first contact of a first pair and a second contact of the first pair and a first contact of a second pair and a second contact of the second pair, said contacts being arranged sequentially in the order of first contact of said first pair, second contact of said first pair, first contact of said second pair, second contact of said second pair, where said second contact of said first pair is adjacent said first contact of said second pair;

said termination end of said first contact of the first pair and the termination end of said first contact of the second pair being positioned in a first plane;

said termination end of said second contact of the first pair and the termination end of said second contact of the second pair being positioned in a second plane different than said first plane;

said first contact of the first pair including a first arm extending from said first contact of the first pair and proximate said first contact of the second pair to establish reactance between said first contact of the first pair and said first contact of the second pair; and said second contact of the second pair including a second arm extending from said second contact of the second pair and proximate said second contact of the first pair to establish reactance between said second contact of the second pair and said second contact of the first pair;

wherein said second arm of said second contact of the second pair includes a plate to establish said reactance between said second contact of the second pair and said second contact of the first pair.

2. The telecommunications plug of claim 1 wherein said reactance is capacitance.

3. The telecommunications plug of claim 1 wherein said reactance is inductance.

4. The telecommunications plug of claim 1 wherein said second contact of the first pair includes a contact arm extending from said second contact of the first pair and proximate said second contact of the second pair.

5. The telecommunications plug of claim 4 wherein said contact arm includes a further plate, said further plate being positioned proximate said plate of said second contact to the second pair to establish said reactance between said second contact of the first pair and said second contact of the second pair.

* * * * *

UNITED STATES PATENT AND TRADEMARK OFFICE

CERTIFICATE OF CORRECTION

PATENT NO. : 6,379,174 B1
DATED : April 30, 2002
INVENTOR(S) : Siemon et al.

It is certified that error appears in the above-identified patent and that said Letters Patent is hereby corrected as shown below:

Column 4,
Line 37, after “to” delete “wiring” and insert therefor -- wire --.

Column 6,
Line 5, after “respective” delete “wiring” and insert therefor -- wire --.
Line 41, after “onto” delete “wiring” and insert therefor -- wire --.
Line 52, before “circular” delete “a”.

Column 7,
Line 63, after “when” delete “housing” and insert therefor -- housings --.
Line 66, after “Handle” delete “ends” and insert therefor -- end --.

Column 8,
Lines 15 and 19, after “polarity” delete “slots” and insert therefor -- arms --.
Line 17, after “extensions” delete “322” and insert therefor -- 324 --.
Line 17, after “protrusions” delete “324” and insert therefor -- 322 --.
Line 46, after “511” delete “allows” and insert therefor -- allow --.

Column 9,
Line 2, after “protrusions” delete “324” and insert therefor -- 322 --.
Line 21, after “of” delete “wiring” and insert therefor -- wire --.
Line 29, after “housing” delete “84” and insert therefor -- 804 --.

Column 10,
Line 28, after “Contact” delete “912” and insert therefor -- 902 --.
Line 31, after “first” delete “contact” and insert therefor -- contacts --.

Signed and Sealed this

Thirteenth Day of September, 2005

JON W. DUDAS
*Director of the United States Patent and Trademark Office*